United States Patent [19]

Folsom

[11] 4,343,404

[45] Aug. 10, 1982

[54] PORTABLE BICYCLE REPAIR RACK

[76] Inventor: Jeffrey A. Folsom, Lions Mouth Rd., Amesbury, Mass. 01913

[21] Appl. No.: 161,457

[22] Filed: Jun. 20, 1980

[51] Int. Cl.[3] ..... A47F 7/00

[52] U.S. Cl. ..... 211/17; 248/114; 248/324; 269/46

[58] Field of Search ..... 211/17, 19, 18, 21, 211/86, 87; 248/286, 324, 214, 215; 269/46

[56] References Cited

U.S. PATENT DOCUMENTS

| | | | |
|---|---|---|---|
| 557,567 | 4/1896 | Eddy | 211/17 |
| 1,629,576 | 5/1927 | Irish | 248/214 |
| 2,701,564 | 2/1955 | Wilhelm | 248/215 X |
| 2,825,469 | 3/1958 | Watkins et al. | 211/105.3 |
| 3,924,751 | 12/1975 | Ballenger | 211/17 |

FOREIGN PATENT DOCUMENTS

| | | | |
|---|---|---|---|
| 1137296 | 5/1957 | France | 211/86 |
| 23261 | of 1897 | United Kingdom | 211/18 |
| 7097 | of 1906 | United Kingdom | 211/18 |

*Primary Examiner*—Roy D. Frazier
*Assistant Examiner*—Robert W. Gibson, Jr.
*Attorney, Agent, or Firm*—Richard T. Oakes

[57] ABSTRACT

A portable bicycle repair rack is disclosed which suspends a bicycle from and in spaced relation to a conventional door.

1 Claim, 3 Drawing Figures

PORTABLE BICYCLE REPAIR RACK

FIELD OF THE INVENTION

This invention relates to devices which suspend a bicycle off the ground in such a way as not to interfere with the moving parts thereof so that it may be serviced. More specifically the present invention relates to a portable bicycle repair rack which may be mounted on a door.

BACKGROUND OF THE INVENTION

In order for a bicycle to be most effectively serviced, it should be suspended in upright position with the wheels off the ground. A bicycle repair rack must be capable of supporting the weight of a bicycle and designed so that it does not interfere with the moving parts of the bicycle while it is suspended therefrom.

One type of bicycle repair rack utilizes a relatively large and heavy base to compensate for the weight of the bicycle it must support. Racks of this type are expensive to manufacture and generally are permanently positioned in one place.

Another type of bicycle repair rack is hung from ceiling members to which they are securely screwed or bolted. Racks of this type are generally impractical for home use.

It is the object of the present invention to provide a portable bicycle repair rack which is inexpensive to manufacture, lightweight and able to be used with any conventional door.

SUMMARY OF THE INVENTION

A portable bicycle repair rack which mounts on a conventional door comprises a boom having a first and a second end, said first end is affixed to a bracket which mounts over the top edge of a door and said second end is attached to a bicycle supporting yoke. A sleeve slidingly engages said boom between said bracket and said bicycle supporting yoke and supports one end of a plurality of bracing means, the other ends of which angularly extend toward and brace against the surface of said door.

DESCRIPTION OF THE PREFERRED EMBODIMENT

Figure 1:
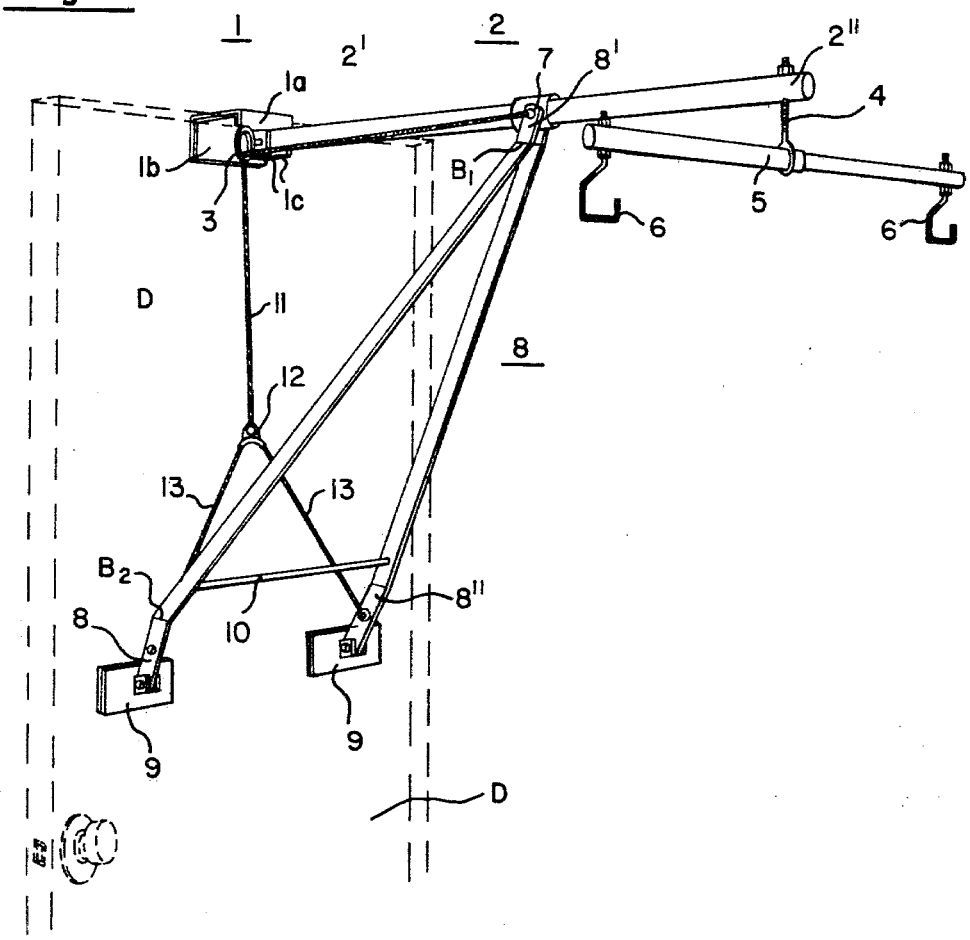
FIG. 1 is a side frontal view of the bicycle repair rack showing its arrangement relative to a door on which it is mounted.

Referring now to the drawings, numeral 1 refers to a bracket means which mounts over the top edge of a door D. Said bracket means is preferably stamped from a single piece of sheet metal and includes two opposing webs 1*a*, 1*b* the inner surfaces of which contact the inner and outer surface of said door respectively. Said web 1*a* contacting the inner surface of said door additionally includes a pair of spaced wings 1*c* projecting perpendicular from the plane of surface 1*a*. A boom 2, preferably of tubular construction, having two ends is affixed on a first end 2' to said bracket means by eye bolt 3. Said first end 2' of said boom is inserted between wings 1C to abut the outer surface of web 1*a* whereupon eye bolt 3 passes through said wings 1C and said first end 2' of said boom, so that said wings 1C sandwich said first end 2' therebetween.

A second end 2'' of said boom 2 has eye bolt 4 passing therethrough. The eye of bolt 4 is threaded by a telscoping yoke 5, again preferably of tubular construction. Said yoke has bicycle engaging hooks 6 affixed adjacent to the axial ends thereof. Said yoke is telescopically adjustable so that it may be lengthened or shortened to increase or decrease the distance between hooks 6 in order to accommodate the frame of any size bicycle.

A sleeve 7 slidingly engages boom 2 between said bracket and said bicycle supporting yoke and has attached thereto on opposite sides thereof the first ends 8' of a pair of braces 8. Said first ends 8' are attached to sleeve 7 in such a way that they are free to rotate relative to said attachment to said sleeve. Braces 8 include a first bend $B_1$ which serves to project said braces angularly outwardly relative to said first ends 8'. The second end 8'' of said braces 8 are bent angularly inwardly at $B_2$ to the same degree as that of bend $B_1$. A support pad 9 is attached to said second end 8'' of brace 8 and serves as the foot by which brace 8 contacts the surface of said door. The spacing between said pair of braces 8 is maintained by a rigid member 10 which is positioned between said braces.

A force transferring cable 11 is attached on one end to said sleeve 7, so that it may move in conjunction with said sleeve. From the point of attachment to said sleeve, the cable passes along said boom 2 and is threaded through the eye bolt 3 which attaches bracket 1 to said first end 2' of boom 2. Said cable passes from eye bolt 3 downward to a point between said bracket 1 and said pad means 9 wherein it attaches to cable hook 12. A second cable 13 is attached on each end thereof to said second end 8'' of said braces 8. Said second cable is slidingly engaged by said cable hook 12 between points of attachment thereof to said second end of braces 8.

Figure 2:
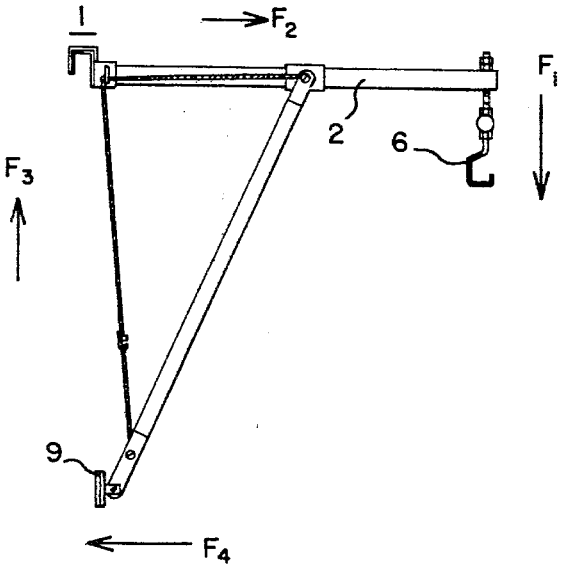
FIG. 2 is a side view of the bicycle repair rack.
Figure 3:
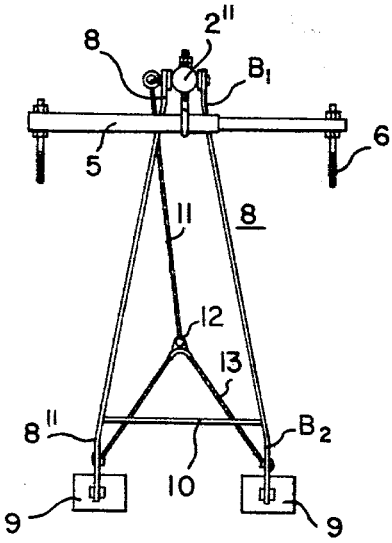
FIG. 3 is a front view of the bicycle repair rack.

Referring to FIG. 2, said force transferring cable is designed to transfer the weight supported by said bicycle repair rack to the door on which the bicycle repair rack is mounted.

When a bicycle is mounted on support hooks 6, a force in the direction of $F_1$ is applied to boom 2. As boom 2 is deflected downward in response to force $F_1$, sleeve 7 responds by sliding along boom 2 exerting a Force $F_2$ in the direction of said bicycle. Force $F_2$ pulls cable 11 with a force $F_3$ in the direction of bracket 1. As cable 11 is pulled in the direction of Force $F_3$, pad support 9 is pulled by Force $F_4$ to firmly brace against said door thereby transferring the weight of said bicycle to the surface of the door.

I claim as my invention:

1. A portable bicycle repair rack which mounts on a conventional door comprising in combination:

(a) a boom having a first and a second end;

(b) a bracket means affixed to said first end of said boom for mounting over the top edge of a door;

(c) a bicycle supporting yoke means on said second end of said boom;

(d) a sleeve slidingly engaging said boom between said bracket means and said bicycle supporting yoke means;

(e) a plurality of elongate bracing means having a first end affixed to said sleeve and a second end extending angularly away therefrom; and (f) cable means extending between said sleeve, said bracket means, and said second end of said bracing means for transferring weight from said bicycle supporting yoke means by way of said bracket means and said bracing means to said door.

* * * * *